United States Patent [19]

Maruya et al.

[11] Patent Number: 4,670,022

[45] Date of Patent: Jun. 2, 1987

[54] FUEL COMPOSITION FOR SPARK-IGNITION ENGINE

[75] Inventors: Takeshi Maruya, Shiki; Katuyuki Yamazaki, Sodegaura, both of Japan

[73] Assignees: Honda Giken Kogyo Kabushiki Kaisha; Idemitsu Kosan Company, Ltd., both of Tokyo, Japan

[21] Appl. No.: 791,297

[22] Filed: Oct. 25, 1985

[30] Foreign Application Priority Data

Nov. 5, 1984 [JP] Japan ..... 59-231424

[51] Int. Cl.[4] ..... C10L 1/18

[52] U.S. Cl. ..... 44/68; 44/67

[58] Field of Search ..... 44/67, 68

[56] References Cited

U.S. PATENT DOCUMENTS

| | | | |
|---|---|---|---|
| 2,151,432 | 3/1939 | Lyons et al. | 44/68 |
| 2,527,987 | 10/1950 | Caron et al. | 44/68 |
| 2,560,542 | 7/1951 | Bartleson et al. | 44/68 |
| 2,678,262 | 5/1952 | Neely et al. | 44/68 |
| 2,697,033 | 12/1954 | Ambrose et al. | 44/68 |
| 3,205,053 | 9/1965 | McCord | 44/68 |
| 3,340,030 | 9/1967 | Gaston et al. | 44/71 |
| 3,580,707 | 5/1971 | Perilstein | 44/51 |
| 3,674,450 | 7/1972 | Filachek et al. | 44/68 |
| 3,694,175 | 9/1972 | Marble | 44/51 |
| 3,959,164 | 5/1976 | Sabol | 252/18 |

OTHER PUBLICATIONS

Guthrie, "Petroleum Products Handbook", 1960, pp. 1–12 and 17–13.

*Primary Examiner*—Y. Harris-Smith

*Attorney, Agent, or Firm*—Frishauf, Holtz, Goodman and Woodward

[57] ABSTRACT

A fuel composition for spark-ignition engines consisting essentially of gasoline and a barium compound in an amount of 100 ppm or more in terms of barium metal and relative to the gasoline, said barium compound being selected from the group consisting of a barium sulfonate, a barium naphthenate, a barium alkylsalicylate and a barium α-alkylalkane monocarboxylate. Spark-ignition engines utilizing this fuel composition operate with improved characteristics relative to adhesion of carbon to the spark plugs. The exhaust from the engine does not degrade the exhaust gas purifying catalyst even when the engine is equipped with an exhaust ignition control device.

13 Claims, No Drawings

FUEL COMPOSITION FOR SPARK-IGNITION ENGINE

BACKGROUND OF THE INVENTION

This invention relates to a fuel composition for spark-ignition engine, more particularly to a fuel composition for spark-ignition engine which inhibits damage of a sparking plug caused by contamination with carbon in a spark-ignition engine equipped with an exhaust emission control device.

In the spark-ignition engine widely used for automobiles, industrial engines, agricultural machinery, etc., i.e., a gasoline engine, a mixed gas having been compressed in a combustion chamber is ignited with an electric spark emitted from a spark plug and the explosion energy of the gas is converted to dynamics.

In such a gasoline engine, incomplete combustion of the gaseous mixture may be caused in the combustion chamber when starting and stopping of the engine is repeated with short intervals, resulting in an adhesion of carbon to the spark plug, the so-called smoldering phenomenon. Accordingly, there remains a problem that a stabilized starting of the engine and a satisfactory driving subsequent thereto cannot be done.

SUMMARY OF THE INVENTION

An object of this invention is to provide a novel fuel composition for spark-ignition engines which is free from such conventional problems and also has an excellent combustibility when the engine is started.

The present fuel composition for spark-ignition engine comprises a hydrocarbon oil having a boiling temperature ranging from 30° to 250° C. and a barium compound mixed in an amount of 100 ppm or more in terms of barium metal and relative to the amount of the hydrocarbon oil.

DESCRIPTION OF THE PREFERRED EMBODIMENT

There is no particular limitation for the fuel oil to be used in the present invention so far as it is a hydrocarbon oil having a boiling temperature ranging from 30° to 250° C. as mentioned above. However, a mixture of a straight-run gasoline obtained from a crude oil by atmospheric distillation with a gasoline fraction obtained from a light oil by a catalytic cracking and a reformate obtained from a naphtha by a catalytic reformation is preferred.

As an oil-soluble barium compound to be mixed in the above-mentioned hydrocarbon oil, there may be mentioned a sulfonate, naphthenate, alkylsalicylate and α-alkylalkane monocarboxylate of barium.

As examples of the barium sulfonate, there may be mentioned an aliphatic barium sulfonate such as barium methanesulfonate, barium ethanesulfonate, etc., and an aromatic barium sulfonate such as barium benzenesulfonate, alkyl-substituted barium benzenesulfonate, etc. As an alkylsalicylate of barium, a lower alkyl salicylate having 1 to 4 carbon atoms is preferred. Further, as the α-alkylalkane monocarboxylate of barium, there may be mentioned one represented by the formula:

$$[H\text{-}(CH_2)_n\text{-}\overset{\overset{R}{|}}{C}H\text{-}COO]_2Ba$$

wherein, R represents an alkyl group having 1 to 4 carbon atoms and n is an integer of 1 to 5.

Among the above-mentioned barium compounds, the alkyl-substituted barium benzenesulfonate such as barium dodecylbenzenesulfonate is particularly preferred.

The amount of the above-mentioned barium compound to be admixed may be 100 ppm or more in terms of barium metal and relative to the amount of the hydrocarbon oil. When the amount to be admixed is less than 100 ppm, the effect of inhibiting adhesion of carbon may not be exhibited sufficiently. On the other hand, the maximum amount of the barium compound to be mixed is not particularly specified. However, said effect may level off even if the barium compound is mixed in an amount exceeding 5,000 ppm in terms of barium metal, resulting in unnecessary increase of cost. Preferable the amount thereof is 500 to 1,000 ppm.

The present fuel composition for spark-ignition engine may be readily prepared by mixing the predetermined amount of each component mentioned above.

In the present fuel composition there may also be optionally incorporated a suitable amount of an anti-oxidant, a metal deactivator, a corrosion inhibitor, a detergent-dispersant, a dyestuff, etc.

EXAMPLE 1

(1) Preparation of the fuel composition

A fuel composition was obtained by use of a gasoline for automobiles (Red Apollo Gasoline, produced by Idemitsu Kosan K.K.) as a hydrocarbon oil, incorporating therein barium dodecylbenzenesulfonate in an amount of 700 ppm in terms of barium metal. Properties of the thus obtained fuel composition are shown in Table 1.

TABLE 1

| Items | Value and property |
|---|---|
| Octane number (research method) | 91 |
| Specific gravity (15/4° C.) | 0.7404 |
| Distillation properties (°C.) | |
| Initial boiling point | 33 |
| 10% Running point | 52.5 |
| 50% Running point | 98.5 |
| 90% Running point | 163.5 |
| 97% Running point | 192 |
| End point | 207 |
| Vapor pressure: 37.8° C. (kg/cm$^2$) | 0.700 |
| Content of lead (ml/liter) | 0.001 or less |
| Content of barium (wt. ppm) | 700 |
| Composition of hydrocarbon (% by volume) | |
| Saturated portion | 49.7 |
| Unsaturated portion | 19.0 |
| Aromatic portion | 31.3 |
| Dissolved gum (mg/100 ml) | 2 |
| Sulphur portion (% by weight) | 0.003 |
| Corrosion of copper plate: 50° C. × 3H (Tarnish No.) | 1 |

(2) Evaluation test (a) To a spark-ignition automobile engine with a displacement of 1.8 liter was supplied the fuel composition which had been prepared in the preceeding paragraph (1). After the predetermined time of driving under the following driving conditions, insulation resistance of a spark plug, torque generated and the unburnt hydrocarbon in the exhaust gas were measured. For comparison a commercially available conventional gasoline (control) having the same composition as shown in Table 1 except that barium is not contained therein was tested according to the same procedures. Results are shown in Table 2.

| Driving conditions | |
|---|---|
| Ambient temperature | 0° C. |
| Water temperature | 30° C. |
| Wind speed | 40 km/hour |
| Revolution | 1,000 rpm |
| Load | −400 mmHg |
| Driving time | 30 min. |

TABLE 2

| Items | Present invention | Control |
|---|---|---|
| Average torque (kg · m) | 12.10 | 11.63 |
| Torque change (kg · m) | 0.52 | 2.26 |
| Hydrocarbon in exhaust gas (ppm) | 13,700 | 16,900 |
| Hydrocarbon change (ppm) | 510 | 3,970 |
| Insulation resistance (MΩ) | | |
| #1 Plug | infinite | 4 |
| #4 Plug | " | 2.5 |
| Starting time of the decline of insulation resistance (minutes after starting of the driving) | | |
| #1 Plug | — | 6 |
| #4 Plug | — | 9.17 |

From the above, it is found that the present fuel composition has less torque change, less amount of unburnt hydrocarbon among the exhaust gas and less change thereof than the control and that the condition of combustion is good. Furthermore, it is seen that the present fuel composition is an excellent fuel composition, since there is observed no decline of insulation resistance of the sparking plug which may otherwise be caused by the soot formed as a result of an incomplete combustion.

(b) Next, 1,000 km driving was conducted using the present fuel composition by mounting an exhaust emission control device charged with an exhaust gas purifying catalyst on the above-mentioned automobile engine to observe the influence of the present fuel composition on a catalyst for purifying exhaust gas from the engine. Then, another 1,000 km driving was conducted in the same driving manner as mentioned above with use of the exhaust emission control device being replaced by a new one and also the present fuel composition by a commercially available lead-free gasoline.

As a result, the performances of the catalyst in the exhaust emission control device, which was as shown in Table 3 prior to driving, was as shown in Table 4 after respective driving.

TABLE 3

| | CO in exhaust gas (g/mile) | Hydrocarbon in exhaust gas (g/mile) | NOx in exhaust gas (g/mile) | Rate of fuel consumption (mile/gallon) |
|---|---|---|---|---|
| Without catalyst | 3.772 | 2.758 | 0.621 | 46.1 |
| Present invention | 0.367 (90.3%) | 0.060 (97.8%) | 0.493 (20.6%) | 45.6 |
| Control | 0.389 (89.7%) | 0.062 (97.8%) | 0.481 (22.5%) | 45.6 |

TABLE 4

| | CO in exhaust gas (g/mile) | Hydrocarbon in exhaust gas (g/mile) | NOx in exhaust gas (g/mile) | Rate of fuel consumption (mile/gallon) |
|---|---|---|---|---|
| Without catalyst | 3.449 | 2.745 | 0.617 | 46.4 |
| Present invention | 0.962 (73.2%) | 0.115 (95.8%) | 0.543 (12.0%) | 46.6 |
| Control | 0.986 (71.4%) | 0.062 (95.8%) | 0.481 (10.5%) | 46.2 |

In Tables 3 and 4, carbon oxide (CO), hydrocarbon and oxide of nitrogen (NOx) in the exhaust gas were measured according to LA-4(C/H) method (U.S.A.). Percentages in parentheses show the rate of purification of each component.

From the above results, it is found that the influence given by the present fuel composition on the catalyst for exhaust gas is equal to that given by other conventional gasolines and has no adverse effect.

As is clear from the above descriptions, the application of this fuel composition for spark-ignition engine sufficiently inhibits the adhesion of carbon to the spark plugs and does not deteriorate the exhaust gas purifying catalyst even when used in an engine equipped with an exhaust emission control device. Thus, the industrial value of the present fuel composition is extremely high as a fuel for automobiles, industrial engines and agricultural machinery.

We claim:

1. A fuel composition for spark-ignition engines consisting essentially of gasoline and a barium compound in an amount of 100 ppm or more in terms of barium metal and relative to the gasoline, said barium compound being selected from the group consisting of a barium sulfonate, a barium naphthenate, a barium alkylsalicylate and a barium α-alkylalkane monocarboxylate.

2. The fuel composition for spark-ignition engines of claim 1, wherein said barium sulfonate is an alkyl-substituted barium benzene sulfonate.

3. The fuel composition for spark-ignition engines of claim 2, wherein said barium benzenesulfonate is barium compound.

4. The fuel composition for spark-ignition engines of claim 1, wherein the amount of the barium compound is 500 to 1000 ppm in terms of barium metal and relative to the gasoline.

5. The fuel composition for spark-ignition engines of claim 2, wherein the amount of the barium compound is 500 to 1000 ppm in terms of barium metal and relative to the gasoline.

6. The fuel composition for spark-ignition engines of claim 3, wherein the amount of the barium compound is 500 to 1000 ppm in terms of barium metal and relative to the gasoline.

7. The fuel composition for spark-ignition engines of claim 4, wherein said barium compound is a barium sulfonate.

8. The fuel composition for spark-ignition engines of claim 7, wherein said barium sulfonate is selected from the group consisting of barium methanesulfonate, barium ethanesulfonate and barium benzenesulfonate.

9. The fuel composition for spark-ignition engines of claim 4, wherein said barium compound is a barium napthenate.

10. The fuel composition for spark-ignition engines of claim 4, wherein said barium compound is a barium alkylsalicylate.

11. The fuel composition for spark-ignition engines of claim 10, wherein the alkylmoiety of said barium alkylsalicylate is a lower alkyl having 1–4 carbon atoms.

12. The fuel composition for spark-ignition engines of claim 4, wherein said barium compound is a barium α-alkylalkane monocarboxylate.

13. The fuel composition for spark-ignition engines of claim 12, wherein said barium α-alkylalkane monocarboxylate has the formula $$[H(CH_2)_n\overset{\overset{R}{|}}{C}H-COO]_2Ba$$

wherein, R is an alkyl group having 1 to 4 carbon atoms and n is an integer of 1 to 5.

* * * * *